US005321956A

United States Patent [19]

Kemp et al.

[11] Patent Number: 5,321,956

[45] Date of Patent: Jun. 21, 1994

[54] OIL MANAGEMENT AND REMOVAL SYSTEM FOR A REFRIGERATION INSTALLATION

[75] Inventors: George Kemp, Chatham; Troy A. Kemp, Loami, both of Ill.

[73] Assignee: Kemp Industrial Refrigeration, Inc., Chatham, Ill.

[21] Appl. No.: 67,689

[22] Filed: May 26, 1993

[51] Int. Cl.[5] ..... F25B 31/00

[52] U.S. Cl. ..... 62/193; 62/468; 62/84

[58] Field of Search ..... 62/192, 193, 194, 468, 62/470, 471, 472, 473, 84

[56] References Cited

U.S. PATENT DOCUMENTS 3,336,762 8/1967 Patterson ..... 62/472
4,210,001 7/1980 Miller, Sr. ..... 68/468

FOREIGN PATENT DOCUMENTS 211849 7/1984 Fed. Rep. of Germany ..... 62/470
52-51146 4/1977 Japan ..... 62/468

*Primary Examiner*—John M. Sollecito
*Attorney, Agent, or Firm*—Trexler, Bushnell, Giangiorgi & Blackstone

[57] ABSTRACT

A compressor oil management and separation system for refrigeration installations, including a main oil storage tank, a pump, valves and remote control means for selectively directing oil from the tank to any one or more of several compressors. Oil separation units are connected for collecting oil from low pressure refrigerant and delivering such separated oil to the tank for reuse or disposal. Each oil separation unit includes a collection vessel, valves for selectively alternately connecting the vessel with low pressure refrigerant and the tank, and means for increasing pressure within the vessel for forcing oil toward the tank.

16 Claims, 2 Drawing Sheets

OIL MANAGEMENT AND REMOVAL SYSTEM FOR A REFRIGERATION INSTALLATION

The present invention relates to commercial refrigeration installations of the type used in bottling plants or packing plants and, more specifically, to a novel system for managing and recovering compressor oil in such installations.

As is well-known, commercial refrigeration installations of the type contemplated herein usually include a plurality of subcombinations of compressors, condensors, evaporators, and related components. The compressors are provided with oil as a lubricant and, during normal operation, some of the oil becomes entrained in the refrigerant passing through the compressor. Installations of the type contemplated herein use a refrigerant, such as ammonia, which is lighter than oil. It is desirable to separate the entrained oil from the refrigerant to prevent contamination to the extent of reducing the efficiency of the cooling action in the evaporator. In U.S. Pat. No. 4,280,337, issued to the assignee of the present application, one system for separating oil from the refrigerant passing through the evaporator is disclosed. Such prior system is effective in installations where the pressure in the evaporator or surge tank associated therewith is maintained by a back pressure regulating valve substantially above the suction pressure of the inlet side of the compressor. In the prior system, as disclosed in the aforesaid patent, the oil is separated from the ammonia refrigerant prior to passage through the evaporator coils, and is subsequently returned to the refrigerant line for return to the compressor. The present invention contemplates separating oil from the refrigerant prior to passage through the evaporator coils, and also maintaining the oil separate from the refrigerant being returned to the compressor. The present invention also contemplates separating oil from the refrigerant in a "balanced pressure" installation in which there is no back pressure valve, and the pressure in the evaporator or associated surge tank is substantially similar to the inlet pressure of the compressor.

In large, commercial refrigeration installations, there are usually a large number of compressors involved. Such compressors usually require periodic maintenance involving filling or supplementing the lubricating oil. Also, prior refrigeration installations frequently provide an environmental problem created by the necessity for disposing of used or waste oil.

SUMMARY OF THE INVENTION

It is an object of the present invention to provide a novel oil management system for a refrigeration installation, whereby compressor oil may be conveniently stored and delivered to one or more compressors as needed.

A further object of the present invention is to provide a novel oil management system of the above-described type, including novel means for separating oil entrained in the refrigerant, and delivering such separated oil for reuse or disposal.

A more specific object of the present invention is to provide a novel apparatus in a balanced pressure refrigeration system for separating entrained oil from the refrigerant and then delivering such separated oil for reuse and/or disposal.

A still further object of the present invention is to provide a novel apparatus for use in a balanced pressure ammonia refrigeration installation for separating entrained oil from the ammonia in the low pressure side of the installation and subsequently delivering the separated oil for reuse and/or disposal.

A still further object of the present invention is to provide a novel low pressure side oil separation apparatus of the above-described type, capable of returning the separated oil to the compressor without contaminating the refrigerant from which it was separated.

Other objects and advantages of the present invention will become apparent from the following description and the accompanying drawings.

An oil management system of the present system comprises a main oil tank adapted to receive and store a charge of new oil, and also to receive and store for reuse oil which has been separated from the refrigerant used in the refrigeration installation. It is contemplated that the refrigeration installation may include either a small number or a large number of separate compressors. The tank is connected with the crankcases or sumps of each of the compressors, and control means are provided so that an operator may selectively transfer or deliver oil from the tank to each of the compressors as needed. Each individual refrigeration subcombination of a compressor and evaporator is provided with means for separating oil from the low pressure refrigerant within the system and returning such separated oil to the main tank for reuse or disposal. According to one feature of the invention, the refrigeration installation is of the balanced pressure type, and the oil separator system is provided with a novel construction for delivering the separated oil back to a tank or other desired delivery point.

DETAILED DESCRIPTION OF ILLUSTRATIVE EMBODIMENTS

Figure 1:
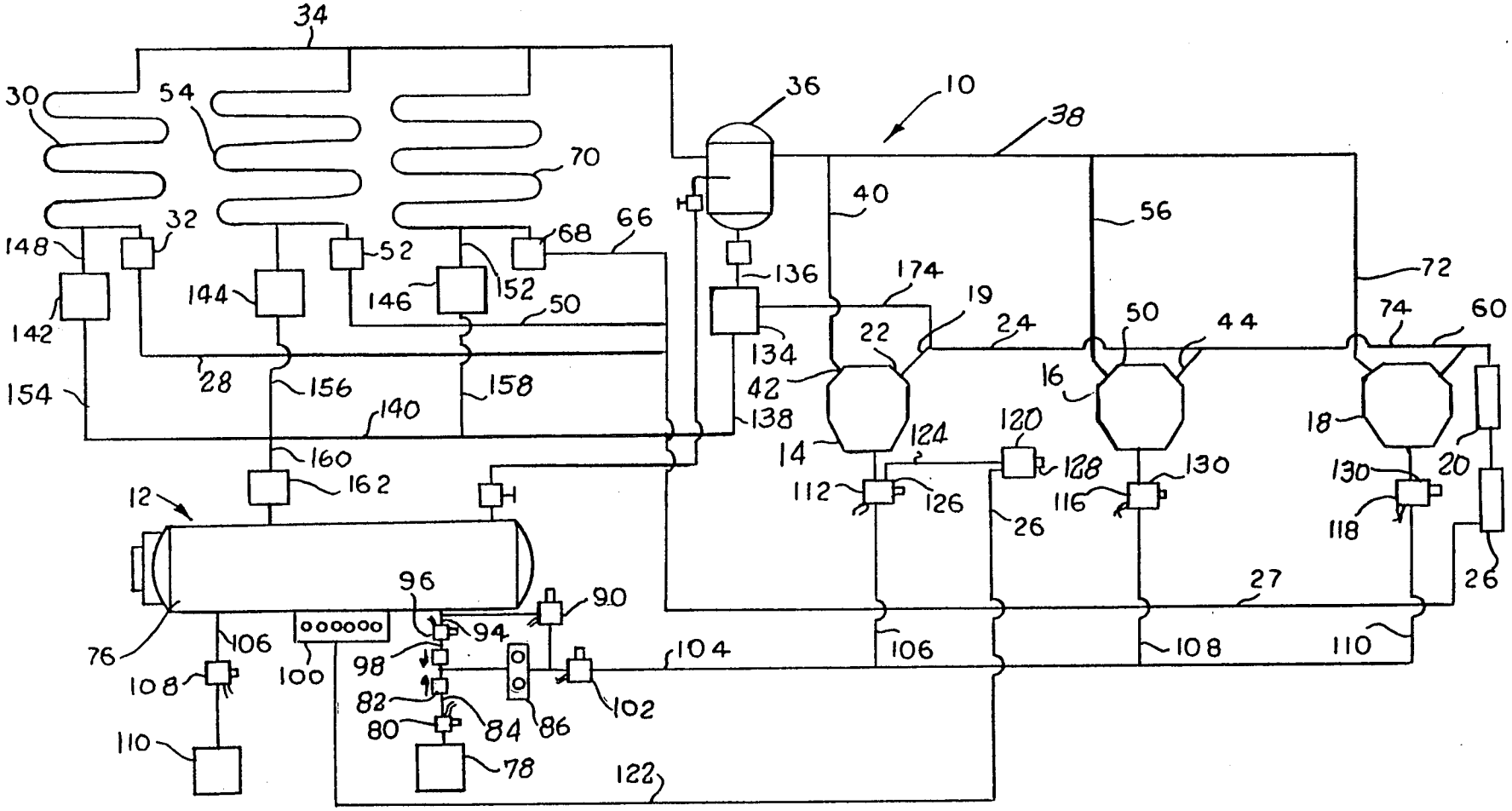
FIG. 1 is a simplified schematic showing an oil management and separation system incorporating the features of the present invention.

In FIG. 1, there is disclosed a refrigeration system 10 into which is incorporated an oil management system 12 incorporating features of the present invention. The refrigeration installation is shown as including three conventional compressors 14, 16, and 18, but it is to be understood that the installation may contain many more compressors, as is usually the case in large bottling plants or packing houses and the like. The individual components of each refrigeration subcombination, including one of the compressors, are of conventional construction and, thus, such components need not be described in detail. It suffices to state that each of the refrigeration subcombinations includes a compressor and an evaporator connected by manifolds and piping with a condenser and an associated receiver.

More specifically, in the embodiment shown, the compressor 14 has a high pressure outlet 22 connected by line 19 with a high pressure manifold 24 which extends to a condenser 20. The condenser 20 is connected with a receiver 26, which in turn is connected by a high pressure refrigerant line or manifold 27. The manifold 27 is connected by branch line 28 with coils of an evaporator 30. While features of the present invention may be incorporated in a refrigeration system utilizing a flooded evaporator wherein the coils are connected with a surge tank, the embodiment disclosed in FIG. 1 shows the high pressure line connected directly with the evaporator coils through a thermostatic or other known type of expansion valve 32. As will be understood, the thermostatic expansion valve 32 serves to reduce the pressure of a refrigerant passing from the high pressure line 28 into the evaporator coil 30, so that as the liquid refrigerant passing through the expansion valve 32 evaporates within the coil 30, the cooling or refrigeration action takes place.

The low pressure gassified refrigerant passes from the evaporator coil 30 to a manifold 34 connected to a suction accumulator tank 36 having an outlet connected with another manifold 38. A branch low pressure or suction line 40 extends from the manifold 38 to the low pressure or suction port 32 of the compressor 14.

The compressor 16 is connected by a high pressure line 44 to the manifold 24 leading to the condensor 20. The high pressure manifold 27 is connected by another high pressure branch line 50 with a thermostatic or other type of expansion valve 52 connected to evaporator coil 54. As shown in FIG. 1, the outlet of the evaporator coil 54 is connected to the manifold 34, so that refrigerant is returned therefrom through the suction accumulator, manifold 38 and a branch suction line 56 connected to an inlet port 58 of the compressor 16.

The components associated with the compressor 18 are essentially the same as those described above. Thus, as shown in FIG. 1, the compressor 18 is connected by high pressure outlet line 60 to the manifold 24 and condensor 20. A high pressure refrigerant branch line 66 extends from the manifold 27 to a thermostatic or other expansion valve 68 associated with another evaporator 70. The evaporator 70 is like the other evaporators, connected with the suction manifold 34, so that the refrigerant is returned therefrom through the accumulator 36, manifold 38, and a suction branch line 72 to a suction or inlet port 74 of the compressor 18.

The oil management and recovery system 12 of the present invention comprises a main storage tank 76 for both receiving and storing new oil and receiving and storing oil which has been separated from the low side of the refrigeration installation. New oil may be delivered to the tank from a drum 78, or other suitable source of supply, connected by solenoid operated shut-off valve 80 and a check valve 82, with an inlet pipe 84 extending to a pump 86. The pump 86 may be used for delivering oil to the sumps of the various compressors, as will be described below, but it is also connected by branch line 88, solenoid operated shut-off valve 90, line 92, and inlet pipe 94 extending to the storage tank 76. Solenoid operated shut-off valve 96 and check valve 98 are also connected in the pipe 94, which is also connected to the inlet pipe 84 of the pump.

A control panel 100 is suitably mounted at any convenient location, such, for example, as near the storage tank 76, and is provided with a suitable electrical or electronic switches connected with the motor for pump 86 and the various solenoid valves mentioned above for operating the valves and the motor in proper sequence to permit oil to be pumped from the drum 78 into the tank 76. More specifically, when it is desired to pump new oil from the drum 78 into the tank, the valve 80 and the valve 90 are opened, and the valve 96 is closed. Another solenoid valve 102 connected in a manifold 104 extending from the outlet of the pump is also closed. When pumping of the new oil into the tank is to be terminated, the valves 80 and 90 are closed.

A drain line 106 extends downwardly from the tank 76, so that when the oil becomes sufficiently worn or contaminated, it can be discharged from the system. In the embodiment shown, the drain line 106 is controlled by a solenoid operated shut-off valve 108 and extends to a waste oil vessel 110, which is constructed and sealed in a known manner, so that the oil may be disposed of without contaminating the environment.

The oil supply manifold 104 is connected by branch lines 106, 108, and 110 with the oil sumps or other oil supply chambers in the individual compressors 14, 16, and 18, respectively. In the embodiment shown, individual solenoid operated shut-off valves 112, 116, and 118 are respectively connected in the branch oil lines 106, 108, and 110, so that upon operation of these valves, oil may be directed to one or more of the compressors.

As will be understood, in a large refrigeration system, the compressors may be spaced a substantial distance from the storage tank 76 and, possibly, from each other. In accordance with a feature of the present invention, the oil control system has provided means for enabling an operator to check the oil level at each compressor, and, whenever needed, actuate the system for delivering new or additional oil to the compressor. While various remote control devices of known construction may be used, the illustrative embodiments shown in FIG. 1 includes a hand-held unit 120 connected by a long extension cable 122 with the control panel 100, and also detachably connected by a cable 124 with a socket 126 of the solenoid valve 112. A push button or similar switch 128 is incorporated in the hand unit 120, so that upon actuation of the switch, additional switching means in the control panel 100 is actuated to energize the pump 86 and simultaneously open the valves 96 and 102. At the same time, the valve 112 is opened, while the other valves 116 and 118 associated with the other compressors remain closed. This, then, enables the oil to be directed selectively to the compressor 14. The shut-off valves 116 and 118 associated with the compressors 16 and 18 also include sockets 130 and 132, to which the cable 124 of the hand-held unit 120 may be selectively connected when it is desired to pump oil into these other compressors. If desired, the cable 124 may be modified so that it could be simultaneously connected to two or more of the inlet oil controlling valves of the compressors for permitting a plurality of the compressors to be filled simultaneously with the oil. Also, if desired, the system could be simplified by substituting manually operable valves, such as ball valves, for the solenoid valves 112, 116, and, 118. With such a modification, the operator would simply energize the pump 86 from the remote location and manually open the valve associated with the compressor which needed additional oil.

In accordance with another important feature of the present invention, the oil management system is provided with means for separating oil from the low pressure refrigerant and delivering such separated oil to the storage tank 76. In the illustrative embodiment disclosed in the drawings, the oil separating means comprises a unit or apparatus 134, having an inlet connected by pipe 136 with a drain opening in the bottom of the suction accumulator 36 and an outlet connected by conduit 138 with an oil-return manifold 140. Additional oil separation units or apparatuses 142, 144, and 146 are respectively connected by drain lines 148, 150, and 152 to low points in the evaporator coils 30, 54, and 70, respectively. It will be appreciated that in the event the refrigeration installation utilizes surge tanks in association with the evaporator coils, the drain lines may be connected to the lower ends of such surge tanks. Outlets of the separator units 142, 144, and 146 are respectively connected by branch lines 154, 156, and 158 with the manifold 140. The return manifold 140 is connected by drain line 160 through filter 162 with the storage tank 76.

Figure 2:
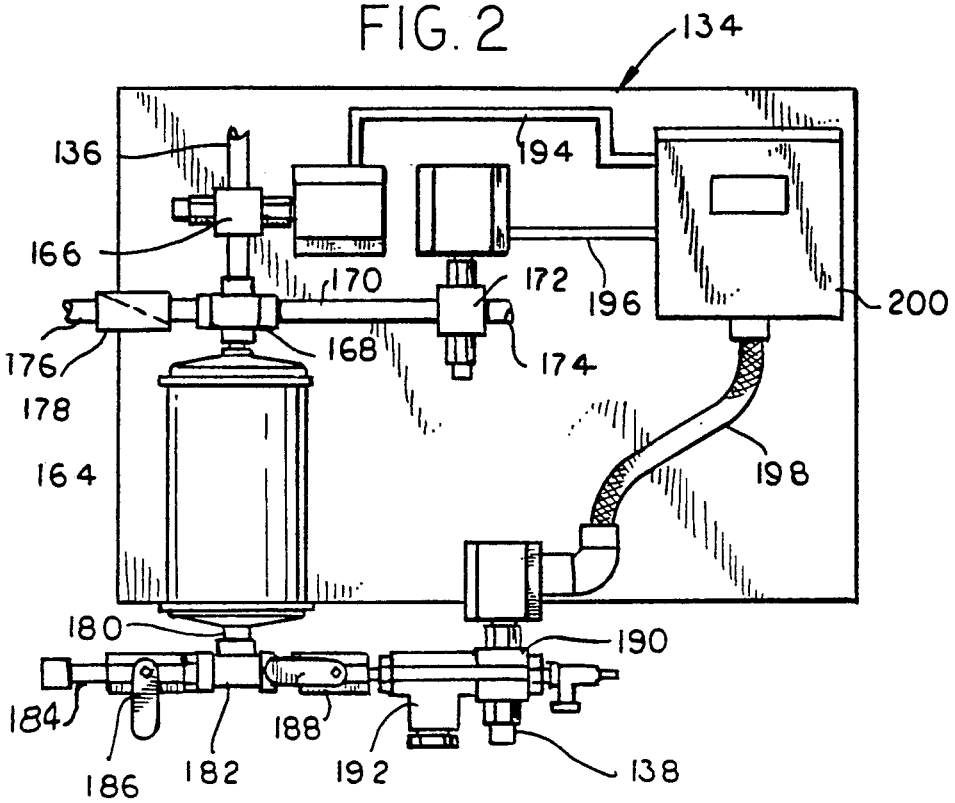
FIG. 2 is a side elevational view showing one embodiment of an oil separating apparatus especially suitable for use in a balanced pressure refrigeration system and adapted to be incorporated into the oil management system shown in FIG. 1.

In the embodiment shown, for the purpose of illustrating the present invention, the oil separation unit or apparatus 134 is shown in greater detail in FIG. 2. The oil separation unit or apparatus 142 is shown in greater detail in FIG. 3. It is to be understood that all of the oil separation units associated with the suction accumulator and all of the evaporator coils could be of identical construction, and could be either of the constructions shown in FIG. 2 or FIG. 3. Furthermore, any desired mix of these constructions could be incorporated in the installation.

Referring now to FIG. 2, it is seen that the oil separation apparatus or unit 134 comprises an oil receiving tank 164 connected with the discharge line 136 extending from the suction accumulator through a solenoid operated shut-off valve 166 and a cross fitting 168. One port of the cross fitting is connected by conduit 170 with another solenoid operated shut-off valve 172, which has its inlet side connected with a high pressure line 174, which in turn is connected to a high pressure conduit extending from one of the compressors. In the illustrative embodiment shown in FIG. 1, the line 174 is connected to the high pressure manifold 24. The purpose of this arrangement will be discussed more fully below. An opposite port of the cross fitting 168 is connected with a vent line 176 through a check valve 178. The vent line 176 extends to, and is connected with, a low pressure refrigerant line, such as the manifold 34.

A discharge line 180 extends from the bottom of the oil accumulator tank 164, and is connected to a T-fitting 182, having one port connected with a manual purge line 184 through a manual shut-off valve 186. An opposite port of the T-fitting is connected with a manual shut-off valve 188, which in turn is connected with a line extending to a solenoid operated shut-off valve 190 through a strainer 192. A discharge port of the valve 190 is connected with line 138, which extends to the oil return manifold 140, as discussed above.

The solenoid valves 166, 172, and 190 are respectively connected by cables 194, 196, and 198 with a timer and control panel 200. This control panel includes timer actuated switches of known construction for opening and closing the valves 166, 172, and 190 in the proper sequence when it is desired to purge oil accumulated in the tank 164. More specifically, the valve 166 is normally open, while the valves 172 and 190 are normally closed. Also during normal operation, the manual shut-off valve 186 is closed, while the valve 188 is open. With the valve 166 open, oil which is heavier than the refrigerant, such as ammonia, gravitates toward the bottom of the suction accumulator 36 and drains through the line 136 into the accumulator tank 164.

It is periodically necessary to purge or drain the oil from the accumulator tank 164 and deliver such separated oil back to the main storage tank 76. In order to accomplish this, the timer in the control panel 200 is adjusted to initiate the necessary valve opening and closing sequence at desired intervals. Specifically, the normally open valve 166 is closed, and the normally closed valves 172 and 190 are open. When this occurs, high pressure refrigerant is delivered through the line 174 to the upper end of the tank 164 and forces accumulated oil out through the bottom and the open valve 190 and back to the tank 76. A timer may be adjusted for initiating the purging action at any desired interval which may typically be up to a few hours in length, and the actual purging operation may extend from a few seconds to hundreds of seconds. The length of the interval between purgings and of the actual purging operation will vary from installation to installation, and may be adjusted in accordance with the need. At the end of the purging operation, the valves 172 and 190 are again closed, while the valve 166 is open.

Figure 3:
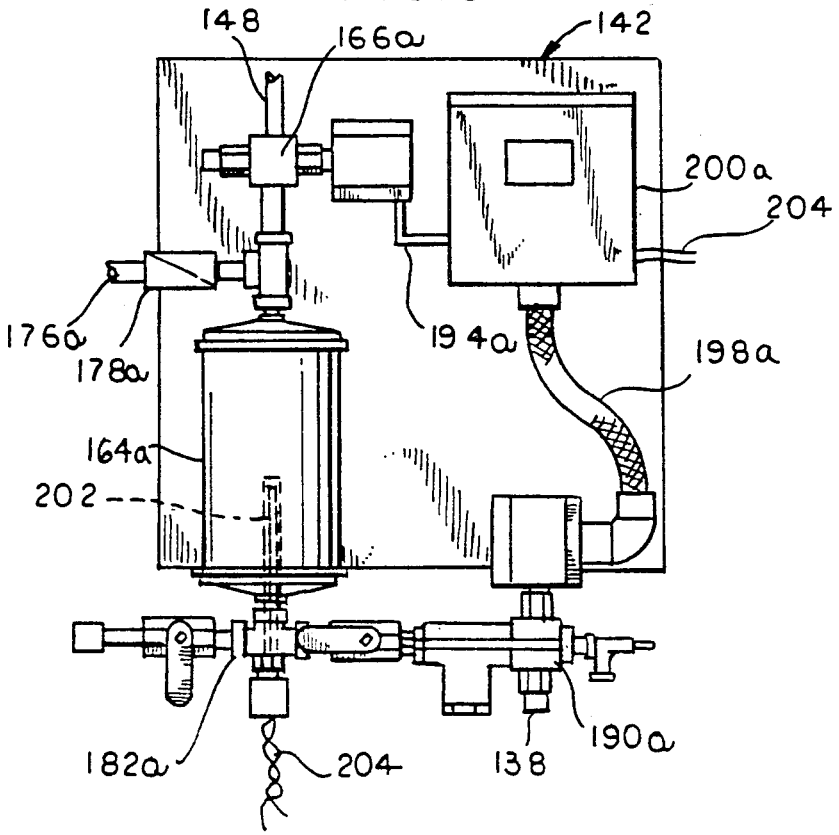
FIG. 3 is a side elevational view showing another embodiment of an oil separating apparatus incorporating features of the present invention and adapted to be incorporated into the system shown in FIG. 1.

Referring now to FIG. 3, the oil separation apparatus or unit 142 incorporates elements which are essentially identical to those described above in the unit 134, as indicated by the application of identical reference numerals with the suffix "a" added to corresponding parts. In the unit 134, high pressure refrigerant from the line 174 is used for creating pressure in the separator accumulator tank for delivering the accumulated oil back to the main storage tank. In the embodiment of FIG. 3, the connection to the high pressure line is eliminated and other means are provided for creating a back pressure in the tank **164*a* for purging accumulated oil. More specifically, a heater 202 is inserted into the tank 164*a* and is electrically connected by cable 204 with the control panel 200. As will be understood, the accumulator tank 164 will contain not only separated oil, but also a volume of the refrigerant or ammonia, which passes from the evaporator along with the oil. In order to purge collected oil from the tank 164*a*, the timer and switching apparatus within the control panel 200*a* is such as to initially close the valve 166*a* and open the valve 190*a*. At the same time, the heater 202 is energized for heating the refrigerant within the tank 164*a*, and thus causing the refrigerant to expand and increase the pressure within the tank sufficiently to force the accumulated oil out of the bottom of the tank 164*a* and back to the main storage tank 76**.

While a preferred embodiment of the present invention has been shown and described herein, various modifications may be made in the refrigeration installation, piping, and other structural details without departing from the spirit and scope of the appended claims. For example, in the refrigeration installation, one or more of the evaporators could be of a type utilizing a back pressure valve and a low pressure oil recovery unit, such as disclosed in the above-mentioned U.S. Pat. No. 4,280,337, which disclosure is incorporated herein by reference.

The invention is claimed as follows:

1. In a refrigeration installation having a plurality of separate compressors for receiving low pressure refrigerant and delivering high pressure refrigerant and associated condensers and an evaporator, an oil management system comprising an oil tank, piping between said tank and said compressors for directing oil from the tank to each of the compressors, selectably operable valves connected in said piping for selectably permitting passage of oil to each of said compressors, an oil separation vessel having an inlet connected for accumulating oil from low pressure refrigerant and an outlet, a first valve connected for selectably alternately opening and closing said inlet, a second valve connected for closing said outlet when said first valve is open, and for opening said outlet when said first valve is closed, and means connected with said vessel for removing oil therefrom when said outlet is open and delivering the oil to said tank said means for removing oil further comprises means for increasing pressure in said vessel when said first valve is closed and said second valve is open.

2. An oil management system, as defined in claim 1, wherein said means for increasing pressure in the vessel comprises a third valve and additional piping for connecting said vessel to high pressure refrigerant when said first valve is closed.

3. An oil management system, as defined in claim 1, wherein said means for increasing pressure in said vessel comprises a heater for heating said vessel and, thus, raising gas pressure therein.

4. An oil management system, as defined in claim 1, which includes a pump connected in said piping for pumping oil from said tank to said compressors and control means connected with said pump for selectably actuating said pump for directing oil from the tank to one, or more selected compressors.

5. An oil management system, as defined in claim 4, wherein said control means comprises a movable, manually operable actuating unit positionable by an operator at different desired locations.

6. A compressor oil management system in combination with a refrigeration installation, including a plurality of separate compressors, each of which is connected with an associated condenser and an evaporator, high pressure lines connecting high pressure sides of the compressors to the condenser, and the condenser to the evaporators through pressure reducing means, low pressure lines connecting the evaporators to suction sides of the compressors, said oil management system comprising a main oil tank, means, including a pump and solenoid actuated valves, for selectably delivering oil from said tank to said compressors, and oil separation units connected with each of said evaporators respectively, including means for separating oil from low pressure refrigerant and delivering said separated oil to said tank said oil separation units include an oil accumulator vessel having an inlet and an outlet, a first shut-off valve between said inlet and an associated evaporator, a second shut-off valve between said outlet and said tank, and control means for selectably closing said second valve and opening said first valve during accumulation of oil in said vessel, and for closing said first valve and opening said second valve during delivery of separated oil from the vessel to the tank.

7. An oil management system, as defined in claim 6, which includes means for increasing pressure in said vessel when said first valve is closed for forcing oil from the vessel.

8. An oil management system, as defined in claim 6, which includes a drain line from said tank connectable to an oil disposal container for permitting disposal of used oil.

9. An oil management system, as defined in claim 6, which includes a suction accumulator connected in said low pressure lines between said evaporators and said compressors, and another oil separation unit connected with said suction accumulator for separating oil from low pressure refrigerant in said suction accumulator, and delivering, said separated oil to said tank.

10. An oil management system, as defined in claim 6, which includes remote control means for selectably actuating said solenoid valves for selectively delivering oil from said tank to one or more of said compressors.

11. A compressor oil management system in combination with an ammonia refrigeration installation, including a plurality of compressors for receiving low pressure refrigerant and delivering high pressure refrigerant, and having an oil sump, said compressors being associated with a condenser and evaporators, said system including an oil tank, piping connecting said tank with each compressor sump, means for selectably delivering oil from said tank to each compressor sump, and means for separating entrained oil from low pressure refrigerant and returning the separated oil to said tank said means for separating entrained oil comprises a vessel having a low pressure inlet communicating with one of said evaporators for receiving accumulated oil and refrigerant, said vessel having an outlet connected with said tank, first and second shutoff valves connected for alternatively opening and closing said inlet and said outlet, and means for increasing pressure in said vessel when said inlet is closed and said outlet is open for forcing accumulated oil from the vessel to the tank.

12. An oil management system, as defined in claim 11, wherein said means for increasing the pressure in the vessel comprises means for connecting the vessel with refrigerant at a pressure higher than the pressure cf the refrigerant at said inlet.

13. An oil management system, as defined in claim 11, wherein said means for increasing pressure in said vessel comprises a heater.

14. An oil separation apparatus connected to a low pressure refrigerant line in a refrigeration system, said apparatus comprising a separated oil accumulation vessel having an inlet connectable with low pressure refrigerant and an outlet, first and second shut-off valves respectively connected for opening and closing said inlet and said outlet, control means for closing said second valve and opening said first valve for permitting accumulation of separated oil in said vessel, and operable for closing said first valve and opening said second valve for permitting oil to be discharged from said vessel, and means for increasing pressure in said vessel when said first valve is closed and said second valve is open for forcing separated oil from said vessel.

15. An oil separation apparatus, as defined in claim 14, wherein said means for increasing pressure in said vessel comprises means connectable with high pressure refrigerant in a refrigeration installation.

16. An oil separation apparatus, as defined in claim 14, wherein said means for increasing pressure in said vessel comprises a heater assembled with said vessel.

* * * * *